United States Patent [19]

Gernon, Sr.

[11] 4,041,874

[45] Aug. 16, 1977

[54] APPARATUS FOR ROTATING AND INDEXING MINIATURE TRAIN TURNTABLES

[76] Inventor: Clarke J. Gernon, Sr., 4660 Fleet Drive, Baton Rouge, La. 70809

[21] Appl. No.: 643,628

[22] Filed: Dec. 23, 1975

[51] Int. Cl.[2] ..... B61J 1/02; B60S 13/02

[52] U.S. Cl. ..... 104/38; 104/147 A

[58] Field of Search ..... 104/38, 35, 36, DIG. 1, 104/45, 47, 147 A, 150; 46/216, 23, 16, 17, 1 K; 246/273, 415 A, 473 A

[56] References Cited

U.S. PATENT DOCUMENTS

| | | | |
|---|---|---|---|
| 2,629,336 | 2/1953 | Seidel | 104/38 |
| 2,823,622 | 2/1958 | Prewitt | 104/38 |
| 2,911,922 | 11/1959 | Mahan et al. | 104/38 |
| 3,534,688 | 10/1970 | Ernst | 104/35 |
| 3,695,182 | 10/1972 | Ernst | 104/38 |
| 3,705,553 | 12/1972 | Ernst | 104/35 |

*Primary Examiner*—Robert J. Spar

*Assistant Examiner*—Randolph A. Reese

*Attorney, Agent, or Firm*—J. Gibson Semmes

[57] ABSTRACT

The apparatus provides for the rotation and precise positioning of miniature train turntables so as to allow miniature locomotives and/or other miniature railroad rolling equipment to roll onto, or off of, the miniature turntable from, or to, the track to which the said apparatus has positioned the miniature turntable. Additionally, the apparatus provides electrical circuitry for the determination of the phase relationship between the miniature train turntable and the position of interest; in the case of electrically driven miniature trains, it provides circuitry for the electrical activation of the track to which the apparatus has positioned the miniature turntable; it provides circuitry for maintaining the polarity of tracks peripherally related to the miniature turntable so as to allow the movement of miniature locomotives and/or other miniature railroad rolling equipment onto, or off of, the miniature turntable from, or to, said tracks peripherally related to said turntable.

3 Claims, 3 Drawing Figures

APPARATUS FOR ROTATING AND INDEXING MINIATURE TRAIN TURNTABLES

The present invention relates to the rotation and precise positioning of miniature train turntables. It provides for the preselection of the position to which the miniature turntable will be rotationally displaced. It also provides for the preselection of the phase relationship between the miniature turntable and the said preselected position. This aforementioned phase relationship can be understood by designating one end of the miniature turntable as the 0° end; and by designating the other end of the miniature turntable as the 180° end. If the phase relationship between the miniature turntable and the preselected position is chosen to be 0°, then the miniature turntable will be rotationally displaced, by the apparatus, so as to align the 0° end of the miniature turntable with the preselected position. If the phase relationship between the miniature turntable and the preselected position is chosen to be 180°, then the miniature turntable will be rotationally displaced by the apparatus so as to align the 180° end of the miniature turntable with the preselected position.

The apparatus provides means for maintaining the miniature turntable in the aforementioned preselected position.

In the case of electrically driven nminiature trains, the apparatus provides for the electrical activation of the track peripherally related to the miniature turntable and correspondent to the preselected position, to the exclusion of all other tracks peripherally related to the miniature turntable. Also in this case, the apparatus provides for the maintaining of the polarity of the tracks, peripherally related to the miniature turntable, so as to allow miniature locomotives, and/or other miniature railroad rolling equipment, to move onto, or off of, the miniature turntable from, or to, tracks peripherally related to the miniature turntable without the occurrence of electricl faults, electrical short circuits, and the like. Also in this case, the apparatus provides for the electrical de-activation of all tracks peripherally related to the miniature turntable while the miniature turntable is in motion to prevent unexpected movement of electrically driven miniature railroad rolling equipment.

An understanding of the apparatus and objects of the present invention will be readily attained by those versed in the art from the following description, in which the scope of the unit is not intended to be restricted, reference being made to the accompanying drawings in which.

Figure 1:
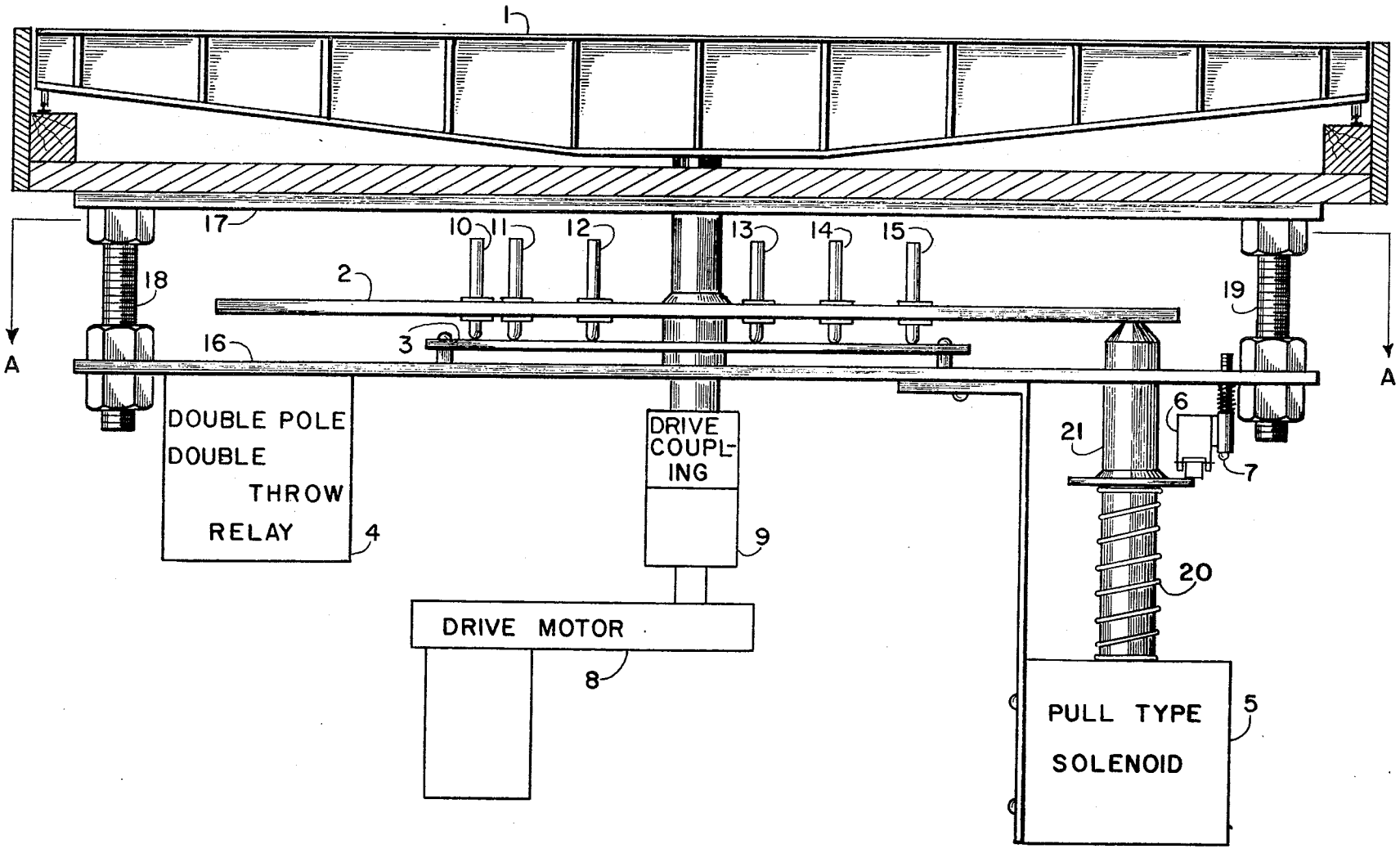
FIG. 1 is a side view of an apparatus for carrying out the invention. Several components, whose detailed illustration is not essential to the understanding of the present invention, have been depicted as labeled representations.

Referring more specifically to the FIGURES, it can be seen that the apparatus, described in FIG. 1, is driving miniature turntable 1, by means of the indexing disc and shaft assembly 2. Support plates 16 and 17 provide structured support as well as bearing and guiding surfaces for the several components of the apparatus, including the indexing disc and shaft assembly 2, slip ring assembly 3, limit switch 6, pull type solenoid 5, solenoid plunger 21, double pole double throw relay 4, and drive motor 8 (support details not shown in FIG. 1). Support plates 16 and 17 are maintained in their relative positions by means of support bolts 18 and 19.

Figure 2:
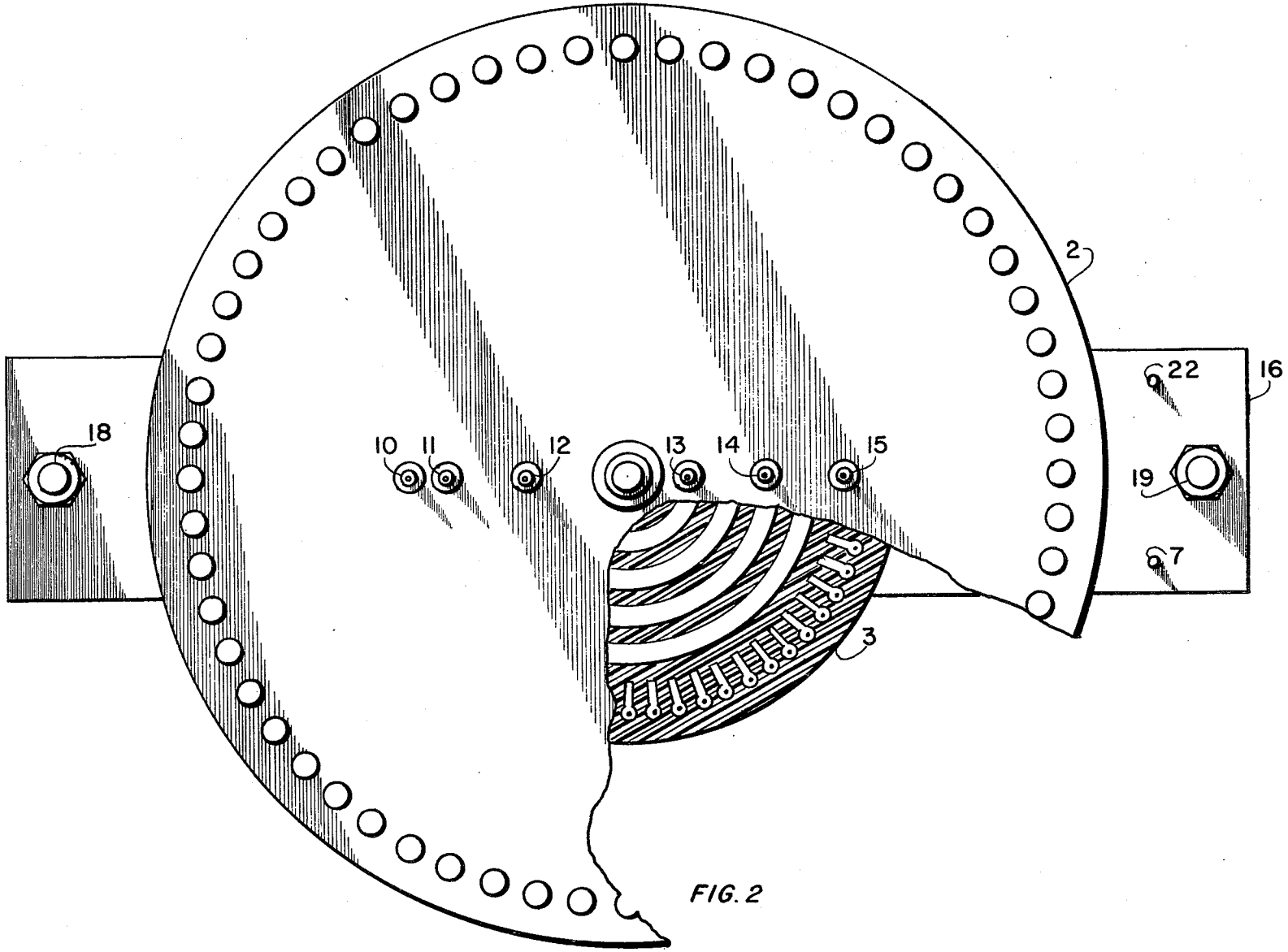
FIG. 2 is a section taken horizontally through the apparatus, depicted in FIG. 1, as indicated by section designation A—A in FIG. 1.

The slip ring assembly 3 consists of four continuous, non-segmental slip rings and one discontinuous segmental slip ring. These slip rings 3 are arranged concentrically in the plane of the slip ring assembly, which is parallel to the plane of the indexing disc 2. The axis of rotation of the indexing disc 2 passes through the center of the aforementioned concentric slip rings 3. These features can be readily observed in FIG. 2.

Slip ring contacts 10, 11, 12, 13, 14 and 15 reside on, rotate with, and are electrically insulated from the indexing disc 2.

Locking pin 21 renders the indexing disc 2 immovable by engaging the holes in the indexing disc 2. The force required to engage locking pin 21 in the holes in the indexing disc 2 is provided by return spring 20. The indexing disc 2 is rendered movable by the disengagement of locking pin 21 in the holes in indexing disc 2. The force required to accomplish this disengagement is provided for by pull type solenoid 5.

The apparatus senses the position of locking pin 21 by means of limit switch 6, which has normally open contacts. The contacts of limit switch 6 are open when locking pin 21 engages indexing disc 2. These contacts are closed when locking pin 21 disengages indexing disc 2. The exact position of locking pin 21 at which the contacts of limit switch 6 open or close is adjustable by means of screws 7 and 22.

The torque required to rotate the indexing disc 2 and, ultimately, the miniature turntable 1, is provided for by means of drive motor 8 through drive coupling 9.

Figure 3:
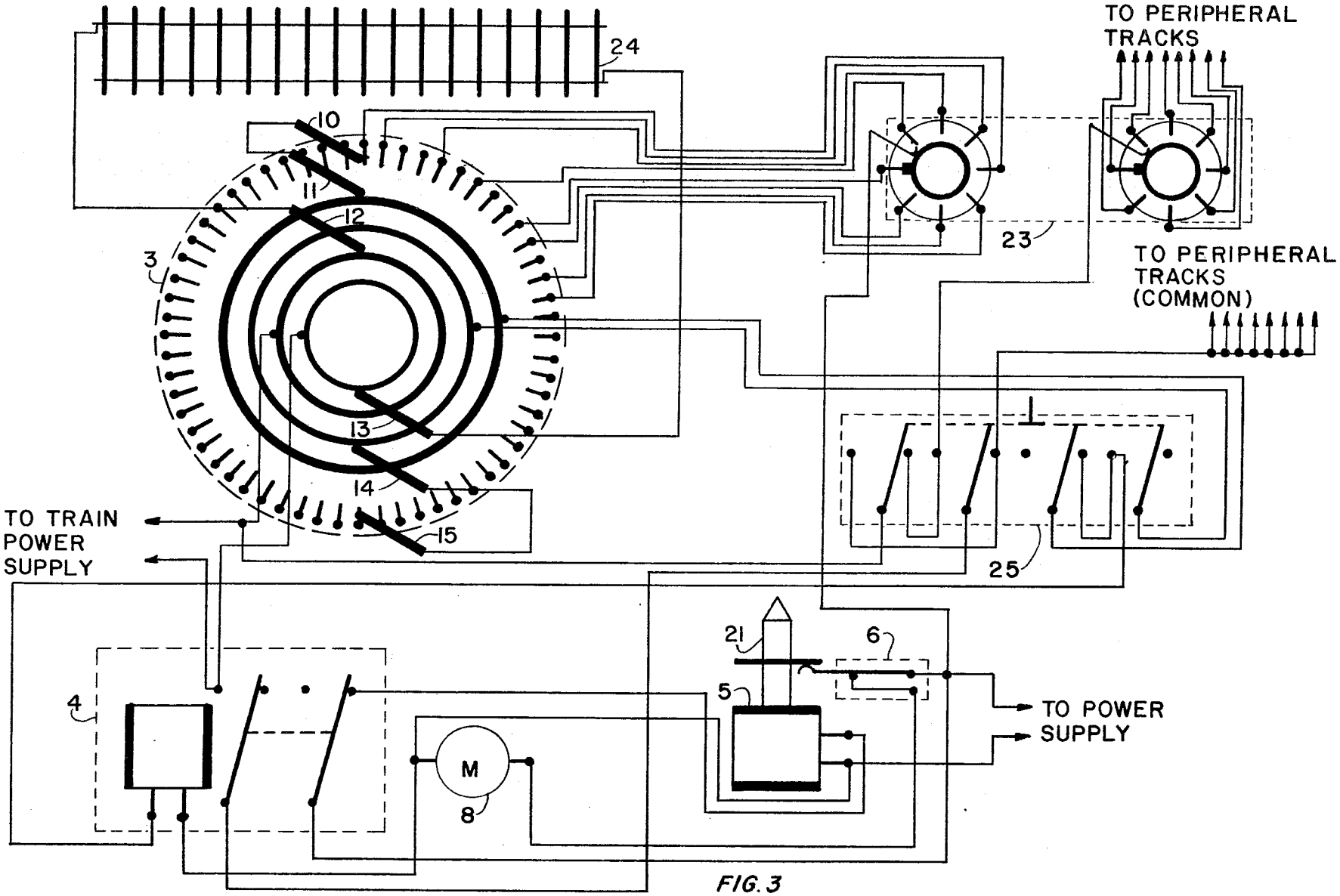
FIG. 3 is an electrical schematic of the present invention, as claimed, depicting electrical interconnection of the several components of the apparatus required to render it operational.

Referring to FIG. 3, track 24 resides on the uppermost horizontal surface of turntable 1 and is called, hereafter, turntable deck track 24. In the case of electrically driven miniature railroad rolling equipment, electrical energy is supplied to turntable deck track 24 by means of slip ring contacts 12 and 13, which contact the slip rings having the second smallest and smallest diameters, respectively.

One pole of the two pole rotary selector switch 23 is the means provided to electrically energize the individual segments of the segmental slip ring. In the case of electrically driven miniature railroad rolling equipment, the other pole of the two pole raotary selector switch 23 is the means provided to electrically activate the track peripherally related to turntable 1, and correspondent to the position of alignment, to the exclusion of all other tracks peripherally related to turntable 1.

Slip ring contacts 10 and 15 correspond to the aforementioned 0° end and 180° end of turntable 1, respectively. Slip ring contacts 10 and 15 both contact the segmental slip ring. Slip ring contact 14 is electrically connected to contact 15. Slip ring contact 11 is electrically connected to contact 10. Slip ring contacts 10 and 15 are the means provided for the apparatus to sense which segment of the segmental slip ring is electrically energized. Two poles of phase switch 25 are the means provided to determine which of contacts 10 and 15 will sense the electrical energization of the segments of the segmental slip ring, and thus determine the aforementioned phase relationship of the turntable to the position of alignment.

The electrical energy supplied to one segment of the segmental slip ring by switch 23 is transmitted to phase switch 25 via slip ring contacts 14 or 11, as the case may be. This electrical energy is in turn transmitted to the coil of double pole, double throw relay 4, which opens one pole so as to de-energize solenoid 5, and so as to allow locking pin 21 to engage the holes of indexing disc 2. Thus, the contacts of limit switch 6 are opened so as to de-energize drive motor 8. Simultaneously, the other pole of relay 4 is closed so as to electrically activate the aforementioned peripheral tracks through switch 23.

Two poles of phase switch 25 are the means provided to maintain the proper polarity of the peripheral tracks when compared to the turntable deck tracks 24.

Preselection of a new position of alignment and preselection of the phase relationship of the turntable to the new position of alignment, by means of switches 23 and 25 respectively, will cause relay 4 to be de-energized; which will cause solenoid 5 to be energized; which will cause pin 21 to dis-engage indexing disc 2; which will cause motor 8 to be energized by the closing of the contacts of limit switch 6; which will cause indexing disc 2 to rotate. When contacts 10 or 15 come in contact with the segment of the segmental slip ring which was electrically energized in the aforementioned preselection of the new position of alignment, relay 4 will be energized through switch 25; which will cause solenoid 5 to be de-energized; which will cause locking pin 21 to engage the hole in indexing disc 2 correspondent to the preselected new position of alignment; which will cause the contacts of limit switch 6 to open; which will cause drive motor 8 to be de-energized. Thus, a complete operational cycle of the apparatus has been explained.

It may be readily observed by inspection of FIG. 1 that the only mechanical connection between the turntable and the control mechanism is through the drive shaft and indexing disc assembly 2. Notworthy also is the fact that the length of the turntable does not constrain the operability of the mechanism. Thus, the mechanism is capable of rotationally displacing and indexing turntables of miniature trains notwithstanding a variation in gauge and/or scale.

While I have depicted and described particular embodiments of my invention, and have presented in the foregoing paragraphs an apparatus capable of being used to effect my invention, modifications and variations thereof will certainly occur to those skilled in the art. Therefore, I intend, that the appended claims comprise these inevitable modifications and variations as being within the true scope and spirit of my invention.

What I claim as new and desire to secure by Letters Patent of the United States is:

1. A device for rotating and precisely positioning model railroad turntables in selective alignment with plural stationary tracks radiating from a turntable pit, comprising in combination with said stationary tracks:

A. a turntable having deck track thereon, said turntable being mounted upon a rotatable shaft within the pit;

B. an indexing disc keyed to the shaft;

C. driving means engaging the shaft to provide torque to rotate the turntable and indexing disc;

D. locking means engageable and disengageable with the indexing disc to render the turntable immovable when engaged with the indexing disc;

E. an electric circuit within the system including:

E1. an electrical switch, the contacts of which are open as the locking means are engaged with the disc and closed when disengaged, said switch being in operative connection with the driving means;

E2. plural stationary contacts in the circuit, one each thereof corresponding to the respective plural tracks radiating from the turntable pit;

E3. rotary switch means to selectively energize a single stationary contact of the plural stationary contacts to the exclusion of others;

E4. two diametrically opposed moveable electrical contacts mounted upon the indexing disc, said moveable contacts having connection with the plural stationary contacts;

E5. a first relay for the selective activation of the locking means as the preselected single energized stationary contact may be encountered;

E6. a second relay interconnecting the moveable electric contacts and the first relay to determine which of said opposed moveable contacts may be sensitive to the electrical state of the stationary contacts.

2. The device of claim 1, further including:

E7. means to electrically energize the turntable deck track;

E8. means to maintain the polarity of the stationary tracks radiating from the turntable compatible with the turntable deck tracks.

3. The device of claim 2, further including:

E9. means to electrically de-energize all said tracks radiating from the turntable, while said turntable may be in motion.

* * * * *